US006074795A

United States Patent [19]

Watanabe et al.

[11] Patent Number: 6,074,795

[45] Date of Patent: Jun. 13, 2000

[54] TONER FOR DEVELOPING ELECTROSTATIC LATENT IMAGE

[75] Inventors: Yohichiroh Watanabe, Fuji; Keiko Shiraishi, Susono; Noboru Kuroda, Tagata-gun; Kohsuke Suzuki, Suntoh-gun, all of Japan

[73] Assignee: Ricoh Company, Ltd., Tokyo, Japan

[21] Appl. No.: 09/345,478

[22] Filed: Jul. 1, 1999

[30] Foreign Application Priority Data

Jul. 1, 1998 [JP] Japan ..... 10-186612

[51] Int. Cl.[7] ..... G03G 9/097

[52] U.S. Cl. ..... 430/109; 430/137

[58] Field of Search ..... 430/106, 109, 430/110, 111

[56] References Cited

U.S. PATENT DOCUMENTS

| | | | |
|---|---|---|---|
| 4,908,290 | 3/1990 | Watanabe et al. | 430/106.6 |
| 4,956,258 | 9/1990 | Watanabe et al. | 430/109 |
| 5,288,577 | 2/1994 | Yamaguchi et al. | 430/106.6 |
| 5,368,972 | 11/1994 | Yamashita et al. | 430/137 |
| 5,429,901 | 7/1995 | Muto et al. | 430/110 |
| 5,972,553 | 10/1999 | Katada et al. | 430/110 |
| 5,981,129 | 11/1999 | Akazawa et al. | 430/110 |

FOREIGN PATENT DOCUMENTS 11-072950 3/1999 Japan .

*Primary Examiner*—John Goodrow

*Attorney, Agent, or Firm*—Oblon, Spivak, McClelland, Maier & Neustadt, P.C.

[57] ABSTRACT

A toner for developing electrostatic latent images which includes at least a binder resin, a colorant and a releasing agent, wherein the releasing agent includes a particulate material capable of absorbing the releasing agent. The particulate material preferably has an absorption rate not less than about 10% by weight in a combination with the releasing agent.

20 Claims, No Drawings

TONER FOR DEVELOPING ELECTROSTATIC LATENT IMAGE

BACKGROUND OF THE INVENTION

1. Field of the Invention

The present invention relates to a toner useful for developing electrostatic latent images formed by an image forming method such as electrophotography, electrostatic recording and the like.

2. Discussion of the Background

In order to fix a dry toner image formed on a receiving material by electrophotography and the like, a pressure-heating method, in which a heated fixing roller contacts the toner image upon application of pressure, is typically used. This method has an advantage in that high speed fixing is possible because the method has good heat efficiency. However, the method has a drawback in that a so-called "offset problem" tends to occur in which a part or all of toner images adheres to the surface of a fixing roller and then the adhered toner images are re-transferred onto another images because the surface of the fixing roller contacts the melted toner images while a pressure is applied to the toner images.

In attempting to solve this offset problem, a fixing method is typically used which uses a fixing roller, the surface of which is formed of a material having a good releasing ability such as silicone rubbers or fluorine-containing resins and on which a releasing oil such as silicone oils is coated. This fixing method is very effective for preventing the offset problem. However, the method has a drawback in that a device for supplying the releasing oil is needed in a fixing unit, and therefore the fixing unit becomes large in size, resulting in high manufacturing cost.

Accordingly, in recent years a method has been used in which a releasing agent is included in a toner without coating a releasing oil on a fixing roller. However, when a releasing agent is included in a toner, problems which occur are that the ability of the toner to be transferred onto receiving materials (hereinafter this ability is referred to as transferability) deteriorates and that the charging ability of a friction-charging member such as a carrier deteriorates because the friction-charging member is contaminated by the releasing agent which bleeds out of the toner particles.

In addition, since the particle diameter of toner particles becomes smaller and smaller in recent years to obtain images having good resolution, it is not easy to satisfactorily transfer such fine toners onto receiving materials.

In attempting to improve the transferability, a method is disclosed in which an ultra fine particulate material which has a particle size on the order of submicrons and which is hydrophobized is externally-added to a toner (i.e., is mixed with toner particles). By this method, the area of the surface of the toner to be contacted with a fixing roller decreases because the ultra fine particulate material adheres on the surface of the particles, and therefore the adhesive power of the toner to the fixing roller decreases. However, when an ultra fine particulate material is externally added to a toner, i.e., a particulate material is present on the top surface of a toner, the following problems tend to occur:

(1) the charging quantity of the toner seriously changes depending on environmental conditions such as temperature and humidity;

(2) a photoconductor to be contacted with the toner, easily deteriorates because the photoconductor is abraded or a film is formed on the surface of the photoconductor, each of which is caused by the toner;

(3) the fixability of the toner deteriorates; and (4) the transferability of the toner deteriorates when used for a long time because the particulate material becomes to be buried in the toner particles over the course of time.

Therefore, the actual situation is that the ultra fine particulate material is externally added to a toner as little as possible.

In addition, Japanese Laid-Open Patent Publication No. 56-1946 discloses a toner in which a particulate silica is externally-added to the toner while a particulate silica is internally-added to (i.e., is included in) the toner to enhance the reliability of the toner. However, the toner has a problem in that the fixability deteriorates because the toner has a relatively high melt viscosity.

Because of these reasons, a need exists for a toner useful for developing electrostatic latent images, which has good transferability and durability and which can produce images having good image qualities without causing the offset problem.

SUMMARY OF THE INVENTION

Accordingly, an object of the present invention is to provide a toner useful for developing electrostatic latent images, which has good transferability and durability and which can produce images having good image qualities without causing the offset problem even when a releasing oil is not coated or is coated on a fixing roller in a minimum amount in a fixing process.

Briefly this object and other objects of the present invention as hereinafter will become more readily apparent can be attained by a toner which includes at least a binder resin, a colorant and a releasing agent, wherein the releasing agent includes a particulate material capable of absorbing the releasing agent.

The particulate material preferably absorbs the releasing agent in an absorption rate of not less than about 10% by weight. The absorption rate is defined later.

In addition, the particulate material preferably has a volume average particle diameter not greater than about 1 $\mu$m.

Further, the particulate material is preferably included in a releasing agent such that all of the releasing agent to be added to the toner is not absorbed to the particulate material, and in addition the releasing agent is preferably present in the toner in an amount of from about 0.5 to about 20% by weight.

The particulate material is preferably selected form the group consisting of silica, titanium dioxide and alumina, which are hydrophobized. The binder resin is preferably selected form the group consisting of epoxy resins, polyester resins and polyol resins. The releasing agent is preferably selected form the group consisting of polyethylene waxes and carnauba wax.

These and other objects, features and advantages of the present invention will become apparent upon consideration of the following description of the preferred embodiments of the present invention.

DETAILED DESCRIPTION THE INVENTION

Generally, the present invention provides a toner which includes at least a binder resin, a colorant and a releasing agent, wherein the releasing agent includes a particulate material capable of absorbing the releasing agent.

The main feature of the present invention is to include a particulate.material in a releasing agent, wherein the particulate material absorbs the releasing agent.

A Releasing agent included in a toner is required to rapidly become a low viscosity liquid when heated by the heat for fixing the toner, and therefore a low molecular weight substances are typically used as the releasing agent. Low molecular weight substances are generally deformed or crushed and has good adhesion, and therefore they tend to contaminate other materials such as a carrier and a photoconductor, resulting in deterioration of reliability such as transferability of the toner and durability of the toner, carrier, photoconductor and the like.

In addition, it is preferable for a releasing agent included in a toner to rapidly rise to the surface of the toner particles when the toner is fixed. Therefore, a releasing agent is generally included in the toner such that the releasing agent forms micro domains in the toner particles utilizing the incompatibility of the releasing agent with the binder resin of the toner. By miniaturizing the micro domains, the transferability and the durability can be improved to some extent.

In the present invention, by including a particulate material in a releasing agent, the size of the micro domains of the releasing agent can be decreased, and in addition, the transferability and the durability of the toner can be dramatically improved to an extent which cannot be achieved only by the miniaturizing of the micro domains.

The reason is considered to be as follows:

(1) since the deference between the melt viscosities of the binder resin and the releasing agent decreases because the melt viscosity of the releasing agent increases due to the addition of the particulate material therein, the releasing agent is uniformly dispersed in the toner particles while forming miniaturized domains when these materials are kneaded to prepare a toner; and (2) the releasing agent is not easily deformed or crushed because the releasing agent is reinforced by the particulate material.

Suitable particulate materials for use in the toner of the present invention include various metal oxides, ceramics, pigments, metal particles, resin particles, charge controlling agents and the like. Specific examples of such metal oxides include oxides of metals such as Si, Ti, Al, Mg, Ca, Sr, Ba, In, Ga, Ni, Mn, W, Fe, Co, Zn, Cr, Mo, Cu, Ag, V, Zr and the like, and complex oxides of these metals. Specific examples of the particulate ceramics include SiC, $Si_3N_4$, TiC, TiN, WC, Sialon and the like. Specific examples of the pigments include clay, talc, calcium carbonate, red iron oxide, carbon black, copper phthalocyanine, barium sulfate, aluminum hydroxide and the like. Specific examples of the resin particles include particles of polymethyl methacrylate, polystyrene, styrene-(meth)acrylate copolymers and the like.

Among these materials, particulate silica, titanium dioxide (titania) and alumina are preferably used.

The volume average particle diameter of the particulate material for use in the present invention is preferably not greater than about 1 $\mu$m.

In the present invention, the particulate material preferably absorbs the releasing agent in an absorption rate not less than about 10% by weight. The absorption rate is defined as follows:

(1) two grams of a releasing agent is melted by being heated at a temperature higher than its melting point:

(2) a particulate material is added to the melted releasing agent little by little while they are kneaded with a spatula so that the mixture forms an aggregation: and (3) the particulate material is continuously added until the mixture of the releasing agent and the particulate material cannot form an aggregation.

The absorption rate is defined by the equation:

$$\text{Absorption rate } (\%)=(Wr/Wpm)\times 100$$

wherein Wr is a weight of the releasing agent used (i.e., 2 grams) and Wr is a maximum weight (g) of the added particulate material beyond which an aggregate of the mixture cannot be formed.

When particulate materials have an absorption rate less than 10% in a combination with a releasing agent, it is preferable to reform the surface of the particulate materials, for example, by hydrophobizing the particulate materials. The hydrophobization can be performed, for example, by the following materials:

dimethyldichlorosilane, trimethylchlorosilane, methyltrichlorosilane, allyldimethyldichlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxysilane, vinyltriethoxysilane, vinylmethoxysilane, vinyl-tris(β-methoxyethoxy) silane, γ-methacryloxypropyltrimethoxysilane, vinyltriacetoxysilane, divinyldichlorosilane, dimethylvinylchlorosilane, octyl-trichlorosilane, decyl-trichlorosilane, nonyl-trichlorosilane, (4-t-propylphenyl)-trichlorosilane, (4-t-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyltrimethoxysilane, hexamethyldisilazane, hexaethyldisilazane, diethyltetramethyldisilazane, hexaphenyldisilazane, hexatolyldisilazane and the like.

In addition, titanate type coupling agents and aluminum type coupling agents can also be employed as the hydrophobizing agent.

Suitable releasing agents for use in the present invention include low molecular weight polyolefins such as polyethylene (polyethylene waxes), polypropylene, oxidized polyethylene and the like; natural waxes such as bees wax, carnauba wax, montan wax, and the like; higher fatty acids such as stearic acid, palmitic acid, myristic acid, and the like; metal salts or amides of these higher fatty acids; and the like. Among these releasing agent, polyethylene waxes and carnauba wax are more preferable.

These releasing agents can be employed alone or in combination. The melting point of these releasing agents is preferably from about 60 to about 160° C. to prepare a toner having good preservability, good resistance to blocking, and good releasability from fixing rollers. The content of the releasing agent in a toner is preferably from about 0.5 to about 20% by weight.

The way how to include a particulate material in a releasing agent is, for example, as follows:

(1) the powders of a particulate material and a releasing agent are mixed with a mixer and the like; and (2) the mixture is heated and melted while being stirred, and then the mixture is cooled.

Suitable binder resins for use in the toner of the present invention include known resins which are used for conventional toners. Specific examples of such resins include polymers of styrene, p-chlorostyrene, vinyl toluene, vinyl chloride, vinyl acetate, vinyl propionate, methyl (meth) acrylate, ethyl (meth)acrylate, propyl (meth)acrylate, n-butyl (meth)acrylate, isobutyl (meth)acrylate, dodecyl (meth)acrylate, 2-ethylhexyl (meth)acrylate, lauryl (meth) acrylate, 2-hydroxyethyl (meth)acrylate, hydroxypropyl (meth)acrylate, 2-chloroethyl (meth)acrylate, (meth) acrylonitrile, (meth)acrylamide, (meth)acrylic acid, vinyl methyl ether, vinyl ethyl ether, vinyl isobutyl ether, vinyl methyl ketone, N-vinyl pyrrolidone, N-vinyl pyridine, butadiene, and the like; copolymers of the monomers mentioned above; and other resins such as polyester resins, polyurethane resins, polyamide resins, epoxy resins, rosin, modified rosins, terpene resins, phenolic resins, aliphatic resins, aromatic petroleum resins and the like. These resins can be employed alone or in combination.

Suitable colorants for use in the toner of the present invention include known pigments and dyes. These pigments and dyes can be used alone or in combination.

Specific examples of black pigments include carbon black, oil furnace black, channel black, lamp black, acetylene black, azine type dyes such as aniline black; metal-containing azo dyes, metal oxides and complex metal oxides.

Specific examples of yellow pigments include cadmium yellow, mineral fast yellow, nickel titanium yellow, naples yellow, naphthol yellow S, Hansa Yellow G, Hansa Yellow 10G, Benzidine Yellow GR, Quinoline Yellow Lake, Permanent Yellow NCG and Tartrazine Yellow Lake.

Specific examples of orange pigments include molybdenum orange, Permanent Orange GTR, Pyrazolone Orange, Vulcan Orange, Indanthrene Brilliant Orange RK, Benzidine Orange G and Indanthrene Brilliant Orange GK.

Specific examples of red pigments include red iron oxide, cadmium red, Permanent Red 4R, Lithol Red, Pyrazolone Red, calcium salt of Watchung Red, Lake Red D, Brilliant Carmine 6B, eosine lake, Rhodamine Lake B, Alizarine Lake and Brilliant Carmine 3B Specific examples of purple pigments include Fast Violet B and Methyl Violet Lake.

Specific examples of blue pigments include cobalt blue, Alkali Blue, Victoria Blue Lake, Phthalocyanine Blue, metal-free Phthalocyanine Blue, partially-chlorinated Phthalocyanine Blue, Fast Sky Blue and Indanthrene Blue BC.

Specific examples of green pigments include Chrome Green, chromium oxide, Pigment Green B and Malachite Green Lake.

The toner of the present invention may include one or more of known charge controlling agents. Specific examples of such charge controlling agents include Nigrosine, azine type dyes having from 2 to 16 carbon atoms (described in Japanese Patent Publication No. 42-1627), basic dyes such as C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), C.I. Basic Green 4 (C.I. 42000), and lake of these basic dyes; C.I. Solvent Black 8 (C.I. 26150); quaternary ammonium salts such as benzoylmethylhexaldecylammonium chloride, decyltrimethylchloride; dialkyl tin compounds such as dibutyl tin and dioctyl tin; dialkyl tin borate compounds; guanidine derivatives; polyamine resins such as amino-group-containing vinyl polymers and amino-group-containing condensation polymers; metal complexes of monoazo dyes described in Japanese Patent Publications Nos. 41-20153, 43-27596, 44-6397 and 45-26478; complexes of metals, such as Zn, Al, Co, Cr and Fe, of salicylic acid, dialkylsalicylic acids, naphthoic acid or dicarboxylic acids; and sulfonated copper phthalocyanine pigments.

In the present invention, particles such as silica, titanium oxide, alumina and the like, which are hydrophobized, and resin particles may be further externally added to the toner to improve fluidity, developing properties, and transferability of the toner. The particle diameter of such particles is preferably from about 0.01 to about 1 $\mu$m.

The toner of the present invention can be used for one-component developers or two-component developers. The toner may include a magnetic material so as to be a magnetic toner.

When the toner is used for two-component developers, the toner is used together with a carrier. In this case, suitable carriers include iron powders, ferrite powders, magnetite powders, nickel powders, glass beads, and powders in which the surfaces of these powders are coated with a resin.

The toner of the present invention can be manufactured by any known method. For example, constituents of the toner such as a binder resin, a colorant and a releasing agent are melted and kneaded using a kneader. Specific examples of the kneaders include batch operation kneaders such as two-roller kneaders, Banburry's mixer and the like; and continuous two-axis extruders such as KTK type two-axis extruders (manufactured by Kobe Steel Ltd.), TEM type two-axis extruder (manufactured by Toshiba Machine Co., Ltd.), two-axis extruder manufactured by KCK Co., Ltd., PCM type two-axis extruder (manufactured by Ikegai Corporation), and KEX type two-axis extruder (manufactured by Kurimoto, Ltd..); and continuous one-axis kneaders such as Co-kneader manufactured by Buss Co., Ltd.

The thus kneaded mixture are cooled, crushed with a crusher such as a hammer mill, and then pulverized by a pulverizer suchas apulverizerusingjet air. It is preferable that the mixture is pulverized so that the average particle diameter of the pulverization product is from about 3 to about 15 $\mu$m. In addition, the pulverization product is classified by an air classifier and the like such that the particle diameter of particles of the product ranges from about 5 to about 20 $\mu$m.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Prepazation of Releasing Composition A

The following releasing agent and particulate material were mixed with amixer, and then kneaded at 160° C. for 15 minutes, to prepare a releasing composition A.

Low molecular weight polypropylene (releasing agent) 100 (660P, manufactured by Sanyo Chemical Industries Ltd.)

Hydrophobized silica powder (particulate material) 20 (R-972, manufactured by Nippon Aerosil Co., BET specific surface area of about 110 $m^2/g$, volume average particle diameter of not greater than 1 $\mu m$)

The hydrophobized silica had an absorption rate of 182% by weight in a combination with the low molecular weight polypropylene.

Preparation of Toner The following components were mixed with a mixer.

| | |
|---|---|
| Styrene/butyl acrylate copolymer (binder resin) (weight average molecular weight of 200,000) | 100 |
| Carbon black (colorant) | 10 |
| Releasing composition A | 6 |
| Azo dye metallized by chromium (charge controlling agent) | 2 |

The mixture was melted by heating, and kneaded with a two-axis kneader. The mixture was then cooled by rolling, and pulverized and classified. Thus, a black toner having a volume average particle diameter of 10 $\mu m$ was prepared.

Four parts by weight of this toner was mixed with 100 parts by we ight of a carrier, which was coated with a silico ne resin and which had a particle diameter of 50 $\mu m$, to prepare a two-compon ent developer. The thus prepared developer was set in a copier (Imagio MF-530, manufactured by Ricoh Co., Ltd.), and a running test was performed in which 100,000 images were reproduced. In the copier, a silicone oil applying device, which had applied a silicone oil to the fixing roller, was removed from the developing unit, and a paper feeding operation in which 5000 paper sheets were fed through the fixing roller was performed before the running test to remove the residual silicone oil adhered to the fixing roller therefrom.

The initial charge quantity of the toner (i.e., the charge quantity before the running test) and the charge quantity after the running test were measured. In addition, by the running test the durability, transferability and offset resistance of the toner were evaluated as follows:

(1) Durability

The durability of a toner was evaluated by the change of the charge quantity during the running test. In addition, the durability was evaluated by visually observing the reproduced images to determine whether undesired images were reproduced.

(2) Transferability

Transferability of a toner was evaluated by transferring rate of the toner, which was defined by the following equation:

$$\text{Transferring rate } (\%)=(Wt-Wr)/Wt\times 100$$

wherein Wt is a total amount of the toner consumed during the running test, and Wr is a total amount of the toner which was collected by the toner cleaning device during the running test.

Namely, the transferring rate means the ratio of the quantity of the toner which was transferred to the copy sheets to the total quantity of the toner consumed during the running test.

(3) Offset Resistance

The reproduced images were visually observed to determine whether offset problems occur.

The results are shown in Table 1.

As can be understood from Table 1, the toner prepared in Example 1 has good durability because the change of charge quantity was small. The toner has good transferability because the transferring rate of the toner was high (91%). In addition, the toner has good offset resistance because there was no offset problem during the running test.

Example 2

Preparation of Releasing Composition B

The procedure for preparation of releasing composition A in Example 1 was repeated except that the formulation was changed as follows and the kneading temperature was changed to 120° C.

Low molecular weight polyethylene wax (releasing agent) 100 (melting point of 95° C.)

Hydrophobized particulate titania (particulate material) 50 (SST-30A, manufactured by Titan Kogyo KK, BET specific surface area of about 90 $m^2/g$, volume average particle diameter of not greater than 1 $\mu m$)

The hydrophobized titania had an absorption rate of 51% by weight in a combination with the low molecular weight polyethylene wax.

Preperation of Toner

The following components were mixed with a mixer.

| | |
|---|---|
| Polyester resin (binder resin) (weight average molecular weight of 100,000) | 100 |
| Carbon black (colorant) | 10 |
| Releasing composition B | 7.5 |
| Azo dye metallized by chromium (charge controlling agent) | 2 |

The mixture was melted by heating, and kneaded with a two-axis kneader. The mixture was then cooled by rolling, and pulverized and classified. One hundred parts by weight of the thus prepared black powder (hereinafter referred to as toner mother particles), which had a volume average particle diameter of 8 $\mu m$, were mixed with 0.2 parts by weight of hydrophobized silica (R805, manufactured by Nippon Aerosil Co., BET specific surface area of about 150 $\mu m^2/g$, volume average particle diameter of not greater than 1 $\mu m$). Thus, a toner was prepared by externally adding the hydrophobized silica to the mother toner particles.

Four parts by weight of this toner was mixed with 100 parts by weight of a carrier, which was coated with a silicone resin and which had a particle diameter of 50 $\mu m$, to prepare a two-component developer. The thus prepared developer was evaluated by the same methods as mentioned above in Example 1.

The results are shown in Table 1.

As can be understood from Table 1, the toner also has good durability because the change of the charge quantity is small. In addition, the toner has good transferability (the transferring rate is 93%), and good offset resistance (there was no offset problem).

Example 3

Preparation of Releasing Composition C

The procedure for preparation of releasing composition A in Example 1 was repeated except that the formulation was changed as follows and the kneading temperature was changed to 110° C.

| | |
|---|---|
| Carnauba wax (releasing agent) (melting point of 83° C.) | 100 |
| Hydrophobized particulate alumina (particulate material) | 10 |

-continued

| | |
|---|---|
| (C604, manufactured by Nippon Aerosil Co., BET specific surface area of about 95 $m^2/g$, volume average particle diameter of not greater than 1 $\mu m$) | |

The hydrophobized alumina had an absorption rate of 83% by weight in a combination with carnauba wax.

Preparation of toner

The following components were mixed with a mixer.

| | |
|---|---|
| Epoxy resin (binder resin) (weight average molecular weight of 20,000) | 100 |
| Copper Phthalocyanine pigment (colorant) | 5 |
| Releasing composition C | 5.5 |
| Zn-complex of 3,5-di-t-butylsalicylic acid (charge controlling agent) | 2 |

The mixture was melted by heating, and kneaded with a two-axis extruding kneader. The mixture was then cooled by rolling, and pulverized and classified. One hundred parts by weight of the thus prepared cyan colored toner mother particles, which had a volume average particle diameter of 8 $\mu m$, were mixed with 0.4 parts by weight of hydrophobized silica (R805, manufactured by Nippon Aerosil Co., BET specific surface area of about 150 $m^2/g$, volume average particle diameter of not greater than 1 $\mu m$) to prepare a toner.

Four parts by weight of this toner was mixed with 100 parts by weight of a carrier, which was coated with a silicone resin and which had a particle diameter of 50 $\mu m$, to prepare a two-component developer. The thus prepared developer was evaluated by the same methods as mentioned above in Example 1 except that the copier was changed to a full color copier (PRETER 500, manufactured by Ricoh Co., Ltd., a silicone oil applying device was removed therefrom). In the running test, only the cyan toner was used (without a yellow, magenta and black developer).

The results are shown in Table 1.

As can be understood from Table 1, the toner also has good durability because the change of the charge quantity is small. In addition, the toner has good transferability (the transferring rate is 90%), and good offset resistance (there was no offset problem).

Example 4

Preparation of Releasing Composition D

The procedure for preparation of releasing composition A in Example 1 was repeated except that the formulation was changed as follows and the kneading temperature was changed to 130° C.

| | |
|---|---|
| Low molecular weight polyethylene wax (releasing agent) (melting point of 110° C.) | 100 |
| Hydrophobized particulate silica (particulate material) (HDK2000, manufactured by Wacker, BET specific surface area of about 140 $m^2/g$, volume average particle diameter of not greater than 1 $\mu m$) | 60 |

The hydrophobized silica had an absorption rate of 96% by weight in a combination with the low molecular weight polyethylene wax.

Preperation of Toner

The following components were mixed with a mixer.

| | |
|---|---|
| Epoxy resin (binder resin) (weight average molecular weight of 17,000) | 100 |
| Copper Phthalocyanine pigment (colorant) | 5 |
| Releasing composition D | 4.8 |
| Zn-complex of 3,5-di-t-butylsalicylic acid (charge controlling agent) | 2 |

The mixture was melted by heating, and kneaded with a two-axis extruding kneader. The mixture was then cooled by rolling, and pulverized and classified. One hundred parts by weight of the thus prepared cyan colored toner mother particles, which had a volume average particle diameter of 8 $\mu m$, were mixed with 0.5 parts by weight of a hydrophobized silica (HDK2000, manufactured by Wacker) to prepare a toner.

Five parts by weight of this toner was mixed with 100 parts by weight of a carrier, which was coated with a silicone resin and which had a particle diameter of 50 $\mu m$, to prepare a two-component developer. The thus prepared developer was evaluated by the same methods as mentioned above in Example 1 except that the copier was changed to a full color copier (PRETER 500, manufactured by Ricoh Co., Ltd., a silicone oil applying device was removed therefrom). In the running test, only the cyan toner was used (without a yellow, magenta and black developer). The results are shown in Table 1.

As can be understood from Table 1, the toner also has good durability because the change of the charge quantity is small. In addition, the toner has good transferability (the transferring rate is 95%), and good offset resistance (there was no offset problem).

Example 5

Preparation of Releasing Compsition E

The procedure for preparation of releasing composition A in Example 1 was repeated except that the formulation was changed as follows and the kneading temperature was changed to 130° C.

| | |
|---|---|
| Low molecular weight polyethylene wax (releasing agent) (melting point of 110° C.) | 100 |
| Particulate copper Phthalocyanine pigment (particulate material) | 40 |

The particulate copper Phthalocyanine pigment had an absorption rate of 68% by weight in a combination with the low molecular weight polyethylene wax.

Prepartion of Toner

The following components were mixed with a mixer.

| | |
|---|---|
| Polyester resin (binder resin) (weight average molecular weight of 18,000) | 100 |
| Copper Phthalocyanine pigment (colorant) | 4 |
| Releasing composition E | 3.5 |
| Zn-complex of 3,5-di-t-butylsalicylic acid (charge controlling agent) | 2 |

The mixture was melted by heating, and kneaded with a two-axis extruding kneader. The mixture was then cooled by rolling, and pulverized and classified. One hundred parts by weight of the thus prepared cyan colored toner mother particles, which had a volume average particle diameter of 8 μm, were mixed with 0.3 parts by weight of a hydrophobized silica (HDK2000, manufactured by Wacker) and 0.2 parts by weight of a hydrophobized titania (SST-30A, manufactured by Titan Kogyo KK) to prepare a toner.

Four parts by weight of this toner was mixed with 100 parts by weight of a carrier, which was coated with a silicone resin and which had a particle diameter of 50 μm, to prepare a two-component developer. The thus prepared developer was evaluated by the same methods as mentioned above in Example 1 except that the copier was changed to a full color copier (PRETER 500, manufactured by Ricoh Co., Ltd., which wasmodified so that the coating amount of a silicone oil was controlled so as to be one tenth of the standard coating amount). In the running test, only the cyan toner was used (without a yellow, magenta and black developer). The results are shown in Table 1.

As can be understood from Table 1, the toner also has good durability because the change of the charge quantity is small. In addition, the toner has good transferability (the transferring rate is 95%), and good offset resistance (there was no offset problem).

Example 6

Preparation of Releasing Composition F

The procedure for preparation of releasing composition A in Example 1 was repeated except that the formulation was changed as follows and the kneading temperature was changed to 90° C.

| | |
|---|---|
| Carnauba wax (releasing agent) (melting point of 83° C.) | 100 |
| Particulate crosslinked polymethyl methacrylate (particulate material, volume average particle diameter of 0.2 μm) | 10 |

The particulate polymethyl methacrylate had an absorption rate of 102% by weight in a combination with carnauba wax.

Preparation of Toner

The following components were mixed with a mixer.

| | |
|---|---|
| Polyester resin (binder resin) (weight average molecular weight of 18,000) | 100 |
| Copper Phthalocyanine pigment (colorant) | 5 |
| Releasing composition F | 3.3 |
| Zn-complex of 3,5-di-t-butylsalicylic acid (charge controlling agent) | 2 |

The mixture was melted by heating, and kneaded with a two-axis extruding kneader. The mixture was then cooled by rolling, and pulverized and classified. One hundred parts by weight of the thus prepared cyan colored toner mother particles, which had a volume average particle diameter of 8 μm, were mixed with 0.3 parts by weight of a hydrophobized silica (TS-720, manufactured by Cabot Corp.) and 0.2 parts by weight of a hydrophobized titania (SST-30A, manufactured by Titan Kogyo KK) to prepare a toner.

Four parts by weight of this toner was mixed with 100 parts by weight of a carrier, which was coated with a silicone resin and which had a particle diameter of 50 μm, to prepare a two-component developer. The thus prepared developer was evaluated by the same methods as mentioned above in Example 1 except that the copier was changed to a full color copier (PRETER 500 manufactured by Ricoh Co., Ltd., which was modified so that the coating amount of a silicone oil was controlled so as to be one tenth of the standard coating amount). In the running test, only the cyan toner was used (without a yellow, magenta and black developer).

The results are shown in Table 1.

As can be understood from Table 1, the toner also has good durability because the change of the charge quantity is small. In addition, the toner has good transferability (the transferring rate is 89%), and good offset resistance (there was no offset problem).

Example 7

Preparation of Releasing Composition G

The procedure for preparation of releasing composition F in Example 6 was repeated except that the formulation was changed as follows, i.e., the particle diameter of the particulate polymethyl methacrylate was changed from 0.2 to 1.2 μm.

| | |
|---|---|
| Carnauba wax (releasing agent) (melting point of 83° C.) | 100 |
| Particulate crosslinked polymethyl methacrylate (particulate material, volume average particle diameter of 1.2 μm) | 10 |

Preparation of Toner

The procedures for preparation and evaluation of the toner in Example 6 were repeated except that the releasing component F was changed to the releasing component G in the toner formulation.

The results are shown in Table 1.

As can be understood from Table 1, the decrease of the charge quantity is relatively large, and therefore the 100,000$^{th}$ image had background fouling. In addition, the transferring rate is 73%, which is relatively low compared to the toners in Examples 1 to 6. The toner has good offset resistance (there was no offset problem).

Example 8 ps Preparation of Releasing Composition H

The procedure for preparation of releasing composition A in Example 1 was repeated except that the formulation was changed as follows and the kneading temperature was changed to 110° C.

| | |
|---|---|
| Carnauba wax (releasing agent) (melting point of 83° C.) | 100 |
| Hydrophobized particulate magnetite (particulate material, BET specific surface area of about 4.7 $m^2/g$, volume average particle diameter of not greater than 1 μm) | 250 |

The hydrophobized particulate magnetite had an absorption rate of 18% by weight in a combination with carnauba wax.

Preparation of Toner

The following components were mixed with a mixer.

| | |
|---|---|
| Polyester resin (binder resin) (weight average molecular weight of 18,000) | 100 |
| Carbon black (colorant) | 7 |
| Releasing composition H | 7 |
| Zn-complex of 3,5-di-t-butylsalicylic acid (charge controlling agent) | 3 |

The mixture was melted by heating, and kneaded with a two-axis extruding kneader. The mixture was then cooled by rolling, and pulverized and classified. One hundred parts by weight of the thus prepared black colored mother toner particles, which had a volume average particle diameter of 9 $\mu$m were mixed with 0.3 parts by weight of a hydrophobized silica (TS-720, manufactured by Cabot Corp.) and 0.2 parts by weight of a hydrophobized titania (SST-30A, manufactured by Titan Kogyo KK). Thus, a black toner of the present invention was prepared.

The thus prepared toner was set in a color printer (Color Page Works, which was manufactured by Minolta Co., Ltd. and which used a belt type fixing method in which a small amount of silicone oil is coated on the belt) and evaluated by the same methods as mentioned above in Example 1 except that the copier was changed to the color printer.

The results are shown in Table 1.

As can be understood from Table 1, the toner had good transferability (the transferring rate is 92%), and good offset resistance (there was no offset problem).

Comparative Example 1

Preparatioon of Toner

The procedure for preparation of the toner in Example 1 was repeated except that the formulation was changed as follows:

| | |
|---|---|
| Styrene/butyl acrylate copolymer (binder resin) (weight average molecular weight of 200,000) | 100 |
| Carbon black (colorant) | 10 |
| Low molecular weight polypropylene (releasing agent) (660P, manufactured by Sanyo Chemical Industries Ltd.) | 5 |
| Azo dye metallized by chromium (charge controlling agent) | 2 |

Namely, the procedure for preparation of the toner in Example 1 was repeated except that the releasing composition A did not include the particulate material (i.e., hydrophobized silica). Thus, a comparative toner was prepared.

In addition, the procedure for preparation of the developer in Example 1 was repeated to prepare a two-component developer.

Further, the procedure for evaluation of the toner and developer in Example 1 was repeated.

The results are shown in Table 1.

As can be understood from Table 1, the decrease of the charge quantity of the toner is relatively large, and therefore the 100,000$^{th}$ image had background fouling. In addition, the transferring rate is relatively low (72%), and the transferability is clearly inferior to that of the toner of the present invention prepared in Example 1. However, the toner has good offset resistance (there was no offset problem).

Comparative Example 2

Preparation of Toner

The procedure for preparation of the toner in Example 2 was repeated except that the formulation was changed as follows:

| | |
|---|---|
| Polyester resin (binder resin) (weight average molecular weight of 100,000) | 100 |
| Carbon black (colorant) | 10 |
| Low molecular weight polyethylene wax (releasing agent, melting point of 95° C.) | 5 |
| Azo dye metallized by chromium (charge controlling agent) | 2 |

Namely, the procedure for preparation of the toner in Example 2 was repeated except that the releasing composition B did not include the particulate material (i.e., hydrophobized titania).

In addition, the procedure for preparation of the developer in Example 2 was repeated. Thus, a comparative toner and developer was prepared.

Further, the procedure for evaluation of the toner and developer in Example 1 was repeated.

The results are shown in Table 1.

As can be understood from Table 1, the decrease of the charge quantity of the toner is relatively large, and therefore the 100,000$^{th}$ image has background fouling. In addition, the transferring rate is relatively low (75%), and the transferability is clearly inferior to that of the toner of the present invention prepared in Example 2. However, the toner has good offset resistance (there was no offset problem).

Comparative Example 3

Preparation of Toner

The procedure for preparation of the toner in Example 3 was repeated except that the formulation was changed as follows:

| | |
|---|---|
| Epoxy resin (binder resin) (weight average molecular weight of 20,000) | 100 |
| Copper Phthalocyanine pigment (colorant) | 5 |
| Carnauba wax (releasing agent, melting point of 83° C.) | 5 |
| Zn-complex of 3,5-di-t-butylsalicylic acid (charge controlling agent) | 2 |

Namely, the procedure for preparation of the toner in Example 3 was repeated except that the releasing composition C did not include the particulate material (i.e., hydrophobized alumina).

In addition, the procedure for preparation of the developer in Example 3 was repeated. Thus, a comparative toner and developer was prepared.

Further, the procedure for evaluation of the toner and developer in Example 3 was repeated.

The results are shown in Table 1.

As can be understood from Table 1, the decrease of the charge quantity of the toner is relatively large, and therefore the 100,000$^{th}$ image has background fouling. In addition, the transferring rate is relatively low (67%), and the transferability is clearly inferior to that of the toner of the present invention prepared in Example 3. However, the toner has good offset resistance (there was no offset problem).

Comparative Example 4

Preparation of Toner

The procedure for preparation of the toner in Example 4 was repeated except that the formulation was changed as follows:

| | |
|---|---|
| Polyol resin (binder resin) (weight average molecular weight of 17,000) | 100 |
| Copper Phthalocyanine pigment (colorant) | 5 |
| Low molecular weight polyethylene wax (releasing agent, melting point of 110° C.) | 3 |
| Zn-complex of 3,5-di-t-butylsalicylic acid (charge controlling agent) | 2 |

Namely, the procedure for preparation of the toner in Example 4 was repeated except that the releasing composition D did not include the particulate material (i.e., hydrophobized silica).

In addition, the procedure for preparation of the developer in Example 4 was repeated. Thus, a comparative toner and developer was prepared.

Further, the procedure for evaluation of the toner and developer in Example 4 was repeated.

The results are shown in Table 1.

As can be understood from Table 1, the decrease of the charge quantity of the toner is relatively large, and therefore the 100,000$^{th}$ image has background fouling. In addition, the transferring rate is relatively low (77%), and the transferability is clearly inferior to that of the toner of the present invention prepared in Example 4. However, the toner has good offset resistance (there was no offset problem).

Comparative Example 5

Preparation of Toner

The procedure for preparation of the toner in Example 5 was repeated except that the formulation was changed as follows:

| | |
|---|---|
| Polyester resin (binder resin) (weight average molecular weight of 18,000) | 100 |
| Copper Phthalocyanine pigment (colorant) | 5 |
| Low molecular weight polyethylene wax (releasing agent, melting point of 110° C.) | 2.5 |
| Zn-complex of 3,5-di-t-butylsalicylic acid (charge controlling agent) | 2 |

Namely, the procedure for preparation of the toner in Example 5 was repeated except that the releasing composition E did not include the particulate material (i.e., hydrophobized silica).

In addition, the procedure for preparation of the developer in Example 5 was repeated. Thus, a comparative toner and developer was prepared.

Further, the procedure for evaluation of the toner and developer in Example 5 was repeated.

The results are shown in Table 1.

As can be understood from Table 1, the decrease of the charge quantity of the toner is relatively large, and therefore the 100,000$^{th}$ image has background fouling. In addition, the transferring rate is relatively low (79%), and the transferability is slightly inferior to that of the toner of the present invention prepared in Example 5. However, the toner has good offset resistance (there was no offset problem).

Comprative Example 6

Preparation of Toner

The procedure for preparation of the toner in Example 8 was repeated except that the formulation was changed as follows:

| | |
|---|---|
| Polyester resin (binder resin) (weight average molecular weight of 18,000) | 100 |
| Carbon black (colorant) | 7 |
| Carnauba wax (releasing agent, melting point of 83° C.) | 2 |
| Zn-complex of 3,5-di-t-butylsalicylic acid (charge controlling agent) | 3 |

Namely, the procedure for preparation of the toner in Example 8 was repeated except that the releasing composition H did not include the particulate material (i.e., hydrophobized magnetite).

In addition, the procedure for preparation of the developer in Example 8 was repeated. Thus, a comparative toner and developer was prepared.

Further, the procedure for evaluation of the toner and developer in Example 8 was repeated.

The results are shown in Table 1.

White streaks were observed in the images of from the 10,000$^{th}$ to the 100,000$^{th}$ copy sheet because the toner adhered to the doctor (i.e., toner regulating member). In addition, the transferring rate is relatively low (76%), and the transferability is clearly inferior to that of the toner of the present invention prepared in Example 8. However, the toner has good offset resistance (there was no offset problem).

TABLE 1

| | Initial charge quantity (μc/g) | Charge quantity after running test (μc/g) | Background fouling | Durability | Transferability (transferring rate (%)) | Offset resistance |
|---|---|---|---|---|---|---|
| EX. 1 | −18.3 | −17.5 | No | good | good (91) | good |
| EX. 2 | −21.6 | −20.8 | No | good | good (93) | good |
| EX. 3 | −19.4 | −20.2 | No | good | good (90) | good |
| EX. 4 | −17.8. | −17.3 | No | good | good (95) | good |
| EX. 5 | −18.7 | −17.7 | No | good | good (95) | good |
| EX. 6 | −22.5 | −21.9 | No | good | good (89) | good |
| EX. 7 | −21.9 | −14.2 | yes | acceptable | poor (73) | good |
| EX. 8 | — | — | No | good | good (92) | good |
| COMP. EX. 1 | −17.7 | −9.3 | yes | poor | poor (72) | good |
| COMP. EX. 2 | −22.1 | −10.2 | yes | poor | poor (75) | good |
| COMP. EX. 3 | −21.5 | −7.9 | yes | poor | poor (67) | good |
| COMP. EX. 4 | −18.3 | −9.8 | yes | poor | poor (77) | good |
| COMP. EX. 5 | −19.5 | −11.1 | yes | poor | poor (79) | good |
| COMP. EX. 6 | — | — | yes | poor | poor (76) | good |

As can be understood from Table 1, by using the toner of the present invention which includes a releasing agent containing a particulate material therein, deterioration of durability and transferability, which is the drawbacks of the toners in which a releasing agent is included in the toner particles, can be dramatically improved even when using a fixing roller to which a releasing oil is not applied.

This document claims priority and contains subject matter related to Japanese Patent Application No. 10-186612, filed on Jul. 1, 1999, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner for developing an electrostatic latent image which comprises:

a binder resin, a colorant and a releasing agent, wherein the releasing agent comprises a particulate material that absorbs at least some of the releasing agent.

2. The toner according to claim 1, wherein the particulate material has an absorption rate not less than about 10% by weight in combination with the releasing agent.

3. The toner according to claim 1, wherein the particulate material comprises hydrophobized silica.

4. The toner according to claim 1, wherein the particulate material comprises hydrophobized titanium dioxide.

5. The toner according to claim 1, wherein the particulate material comprises hydrophobized alumina.

6. The toner according to claim 1, wherein the particulate material has a volume average particle diameter not greater than about 1 $\mu$m.

7. The toner according to claim 1, wherein the particulate material is present in the releasing agent in such an amount that all of the releasing agent to be added to the toner is not absorbed in the particulate material.

8. The toner according to claim 1, wherein the releasing agent is present in the toner in an amount of from about 0.5 to about 20% by weight.

9. The toner according to claim 1, wherein the releasing agent comprises a wax selected from the group consisting of polyethylene waxes and carnauba waxes.

10. The toner according to claim 1, wherein the binder resin comprises a resin selected from the group consisting of epoxy resins, polyester resins and polyol resins.

11. A method for manufacturing a toner comprising the steps of:

mixing a releasing agent and a particulate material capable of absorbing the releasing agent to prepare a first mixture;

heating the first mixture such that the releasing agent melts;

kneading the first mixture containing the melted releasing agent;

cooling the first mixture;

combining the mixture with at least a binder resin and a colorant to prepare a second mixture;

heating the second mixture such that the binder resin softens;

kneading the second mixture containing the softened binder resin;

cooling the second mixture; and pulverizing the second mixture.

12. The method according to claim 11, wherein the particulate material has an absorption rate not less than about 10% by weight in a combination with the releasing agent.

13. The method according to claim 11, wherein the particulate material comprises hydrophobized silica.

14. The method according to claim 11, wherein the particulate material comprises hydrophobized titanium dioxide.

15. The method according to claim 11, wherein the particulate material comprises hydrophobized alumina.

16. The method according to claim 11, wherein the particulate material has a volume average particle diameter not greater than about 1 $\mu$m.

17. The method according to claim 11, wherein the particulate material is present in the releasing agent in such an amount that all of the releasing agent to be added in the toner is not absorbed in the particulate material.

18. The method according to claim 11, wherein the releasing agent is present in the toner in an amount of from about 0.5 to about 20% by weight.

19. The method according to claim 11, wherein the releasing agent comprises a wax selected from the group consisting of polyethylene waxes and carnauba waxes.

20. The method according to claim 11, wherein the binder resin comprises a resin selected from the group consisting of epoxy resins, polyester resins and polyol resins.

* * * * *